US006871689B2

(12) United States Patent
Sørensen

(10) Patent No.: US 6,871,689 B2
(45) Date of Patent: Mar. 29, 2005

(54) SAND MOULDING MACHINE WITH IMPROVED SAND BLOW

(75) Inventor: Erik Nyholm Sørensen, Ballerup (DK)

(73) Assignee: Disa Industries A/S, Herlev (DK)

( * ) Notice: Subject to any disclaimer, the term of this patent is extended or adjusted under 35 U.S.C. 154(b) by 90 days.

(21) Appl. No.: 10/470,302

(22) PCT Filed: Feb. 7, 2001

(86) PCT No.: PCT/DK01/00084

§ 371 (c)(1),
(2), (4) Date: Jul. 29, 2003

(87) PCT Pub. No.: WO02/062507

PCT Pub. Date: Aug. 15, 2002

(65) Prior Publication Data

US 2004/0060686 A1 Apr. 1, 2004

(51) Int. Cl.[7] ..... B22C 9/12
(52) U.S. Cl. ..... 164/200; 164/241
(58) Field of Search ..... 164/200, 169, 164/192, 241

(56) References Cited

FOREIGN PATENT DOCUMENTS

| | | | |
|---|---|---|---|
| JP | 1-130841 | * | 5/1989 |
| JP | 7-39996 | * | 2/1995 |

* cited by examiner

*Primary Examiner*—Kiley S. Stoner
*Assistant Examiner*—Len Tran
(74) *Attorney, Agent, or Firm*—Stites & Harbison PLLC; Douglas E. Jackson

(57) ABSTRACT

Moulding machine (1) for the moulding of sand moulds (4, 5) by blowing sand in through slitshaped openings (14, 15) extending across each side plate (16, 17) of a moulding box (6, 7). Into the boxes (6, 7) extend moulding patterns (12, 13). At least one of the end parts (18, 19) of the slitshaped openings has a greater width than the central part (20, 21) thereof. When the sand is blown in through the openings (14, 15) a greater amount of sand is achieved at the peripheral region of the boxes (6, 7) than when the end parts has no greater width than the central part of the opening. Consequently, by the present solution is achieved a greater hardness of the squeezed sand moulds at the peripheral region than by the prior art solutions.

12 Claims, 4 Drawing Sheets

SAND MOULDING MACHINE WITH IMPROVED SAND BLOW

FIELD OF THE INVENTION

The present invention concerns a machine for the moulding of sand moulds by blowing sand in through a slitshaped opening extending across a side plate of a moulding box, into which box extends a moulding pattern. The invention further concerns a side plate having a slitshaped opening for a moulding box.

CLOSEST PRIOR ART

Machines of the above mentioned art are well-known within the field of making sand moulds. The sand moulds are subsequently used for the industrial moulding of metal products, the geometry of which are often highly complex.

Today, two different types of machines or techniques are primarily used; the Matchplate technique and the DISAMATIC® technique.

By the matchplate technique a matchplate having moulding patterns on each sides facing away from each other, is being clamped between two moulding boxes. During the moulding of an upper and a lower sand form the patterns of the matchplate are extending into each of the boxes. A slitformed opening extending across a side plate is arranged in each of the moulding boxes. Simultaneously sand is blown at high velocity in through each slitformed opening and into each box. Thereafter, the sand is being squeezed by the movement of the cope press plate and the drag plate simultaneously in direction towards the matchplate. After the squezing, the boxes are moved away from each other, the matchplate is being removed and eventual cores are placed in the moulds. Thereafter, the boxes are again closed, so that the moulded total volume of the patterns of the matchplate so to say makes the complete cavity of the ready moulded sand forms. The closed sand forms are moved on to the process of pouring the metal product therein.

By the DISAMATIC® technique a side plate having a first pattern is arranged at a first press plate and another side plate having a further pattern is arranged at the opposite press plate, so that two oppositely arranged patterns are extending into the same moulding box. A slitformed opening is arranged in a side plate, normally an upper side plate, so that when sand is blown into the moulding box, the two patterns are simultaneously moulded at sides of the sand mould facing away from each other. Thereafter, the press plates moves in direction towards each other and squeezes the sand. After being removed from the moulding box, the sand mould is placed in closed relation to the previously moulded sand mould on a conveyer. The cavity between the ready moulded sand mould and the previously moulded sand mould constitutes the cavity for the subsequent casting of the metal product.

By both techniques the sand is being squeezed and consequently compacted until a certain pre-calculated maximum pressure force is achieved. The maximum pressure force is being calculated for the degree of compaction of the squeezed sand to be reached in the region of the box into which the major part of the pattern extends. A satisfactory hardness of the compacted sand is thereby achieved in this region into which the major part of the pattern extends, which normally is the central region of the ready moulded sand form. However, in the peripheral region extending around or surrounding the central region a greater length of sand is to be compacted than in the central region. In the sand may be formed a negative or a positive depression depending on the pattern in question. Especially a negative depression is difficult and may lead to an unacceptable low hardness of the squeezed sand. In the outermost peripheral region no pattern extends into the box so the length of sand to be compacted is the greatest possible in the box. In the central region into which the pattern extends the length of sand to be compacted is always shorter than at the peripheral region. Consequently, as the press plate during the squeezing of the sand travels the same distance at central region as at the periphery, the degree of compaction of the squeezed sand is lesser in the peripheral region. Thereby, the hardness of the compacted sand is lesser in the outher peripheral region than in the central region. In the instance of major patterns in the moulding box, the hardness of the compacted sand in the peripheral region may be around 50% or even more of the hardness in the central region.

The object of the present invention is to improve the hardness of the squeezed sand in the regions of the moulding box decline of or essentially free of pattern, such as especially the outer regions of the sand moulds.

By the moulding machine according to the present invention, at least one of the end parts of the slitshaped opening has a greater width than the central part thereof.

Hereby is obtained a greater hardness of the compacted sand of the sand mould in the regions decline of cavities, such as especially the outer regions of the sand moulds. Consequently, the pattern in the moulding box may be arranged closer to the outer side or peripheral region thereof. The outer regions of the sand moulds may even be utilised for smaller cavities for the later moulding of details on the metal product. Important to notice is, that the region of the box available for the pattern moulding the cavity, has become larger in its extension towards the sides. Therefore, a greater capacity for the moulding of the metal products may be achieved by the existing plants.

Secondly is achieved a more even hardness and strength as well through over the sand form. A higher precision of the metal product casted later on in the sand form is therefore to be expected as well due to minimised deformation of the sand form. Furthermore, a higher quality of the surface of the casted product is achieved due to reduced sand penetration.

When the sand is blown through the slitshaped opening into the moulding box in question, a higher quantity of sand than by the prior art will be blown in at the outer peripheral region through the end part of the slitshaped opening having a greater width than the central part. Consequently, when being squeezed, the hardness of the compacted sand achieved in the outer peripheral region is higher than by the prior art. Serious improvements in hardness of up until 20% or even more is achievable.

Due to special design reasons or excessive erosion by the blowing sand on the side plates, the end parts of the slitshaped opening sometimes have to be terminated at a distance from the adjacent side plates of the mould box. In such case the hardness of the squeezed sand is already at its lowest level at the peripheral region at the side plates, so that the improvement in hardness achieved by the inventive solution becomes especially desirable.

When the one elongated side of the slitformet opening is essentially straight and the extension of the width is to the opposite elongated side of the opening the inventive solution may advantageously be applied for the machine utilising the matchplate technique.

Geometrical embodiments simple to manufacture, such as when the end part of the opening has a rectangular shape a triangular shape or even a circular shape is all within the inventive idea.

When the moulding pattern declines gradually from the centre of the box and towards the sides thereof, the width of the opening may advantageously enlarge gradually from the central part of the slitshaped opening and towards the end thereof.

An especially improved hardness in the moulded sand is achieved when the extension of the at least one end part of the opening having an enlarged width is between 4% and 50% of the total length of the slitshaped opening. However, optimal is when both end parts of the opening has an enlarged width.

For a machine performing the DISAMATIC® technique wherein two oppositely arranged patterns are extending into the moulding box during the moulding, it is especially advantageous, when the extension of the width at the end part of the opening is to both opposite sides of the opening in comparison with the central part of the opening having a smaller width. Especially may the shape of the opening at the end part be essentially symmetrical around a longitudinal central axis.

By the inventive side plate for a moulding box the plate comprises a slitshaped opening extending across the side plate, and the at least one end part of the slitshaped opening has a greater width than the central part thereof.

When the opposite longitudinal edges in the slitshaped opening comprise non-parallel surfaces in the central part and comprise parallel, essentially vertical surfaces in the end parts a minimum of erosion is achieved at the pattern when the sand is blown in through the slitshaped opening.

Also may the width at the at least one end part of the slitshaped opening be adjustable by the movement of slidable parts.

DESCRIPTION OF THE DRAWING

The invention will be explained more fully below with reference to the drawing, in which.

DETAILED DESCRIPTION OF ADVANTAGEOUS EMBODIMENTS

Figure 1:
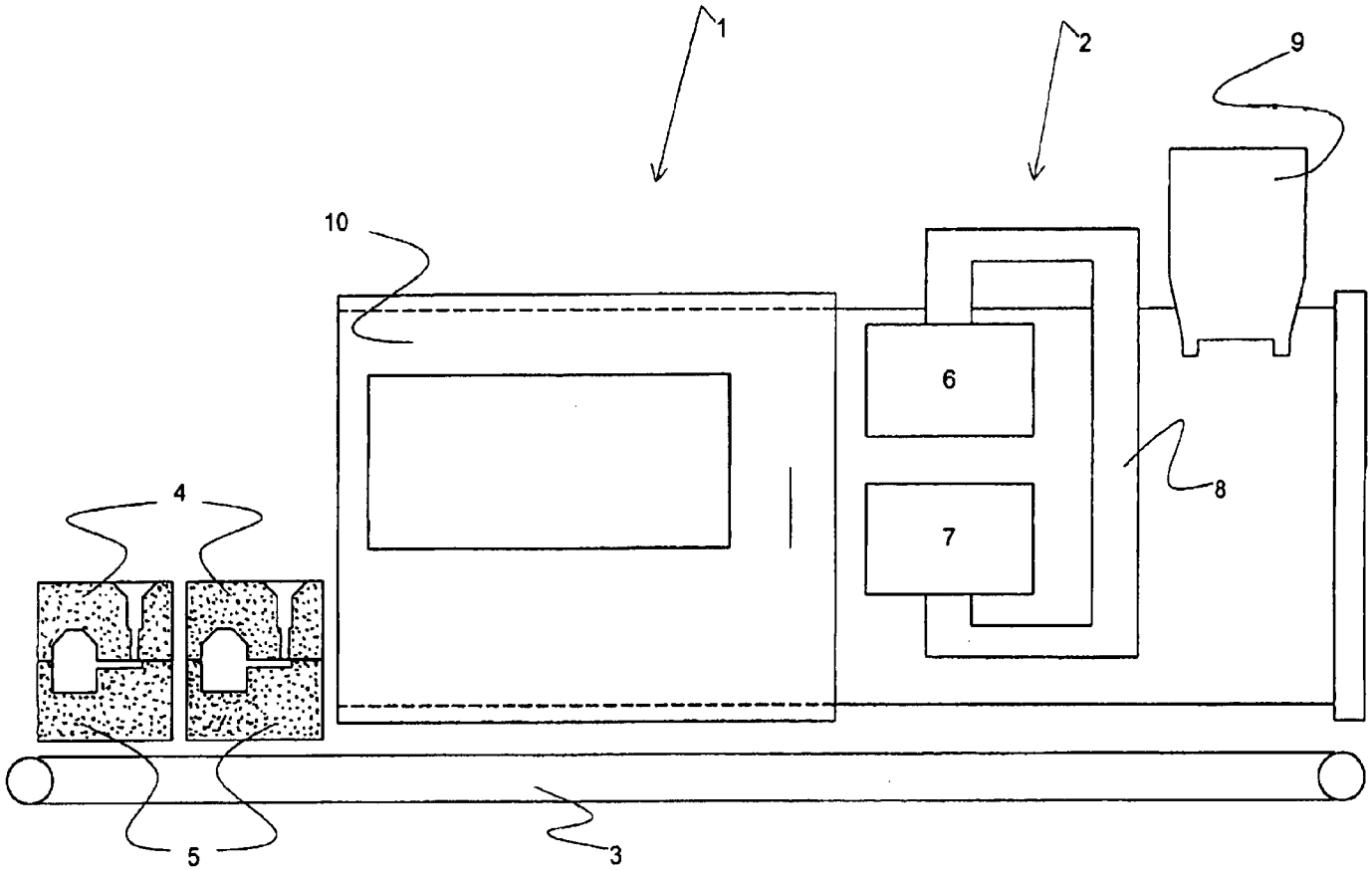
FIG. 1 is a schematic view of a moulding machine according to the invention.

The moulding machine 1 schematically shown in FIG. 1 comprises a squeezing and sand shot section 2 for the moulding of sand moulds 4, 5. Further sections for the control of the machine are not shown as they constitute part of the well-known prior art within the field. A conveyor 3 for the transportation of the closed sand moulds 4, 5 further on to the next process of the moulding of the metal products is arranged under the machine 1. For reasons of clarity the machine is disclosed without further details, which have no importance to the explanation of the present invention.

The squeezing and sand shot section 2 comprises upper and lower moulding boxes 6, 7, which are fixed to and guided by a typically U-formet press 8. By the activation of the press 8 the moulding boxes 6, 7 may be moved in vertical direction, that is in towards each other, or in direction away from each other. The sand container 9 is shown schematically as well as a security covering door 10, which has been drawn to the left, so that the sand shot section is revealed. The door is closed during production.

By the arrangement of the upper and lower sand moulding boxes 6, 7 the machine 1 works according to the matchplate technique. A matchplate 11 having oppositely arranged patterns 12, 13 is clamped between the boxes 6, 7 so that the patterns 12, 13 are extending into the boxes 6, 7 during moulding i.e. FIG. 2. After the matchplate 11 has been clamped between the boxes 6, 7 the sand is blown or shot through slitshaped openings 14, 15 simultaneously into each of the boxes. Each of the moulding boxes 6, 7 comprise a side plate 16, 17 each having a slitshaped opening 14, 15.

Figure 2:
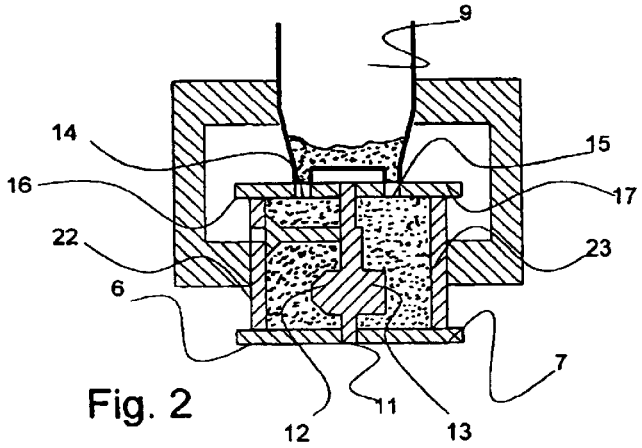
FIG. 2 is a sectional view through a schematically shown squeezing and sand blowing section of the machine in FIG. 1 performing the matchplate technique.
Figure 3:
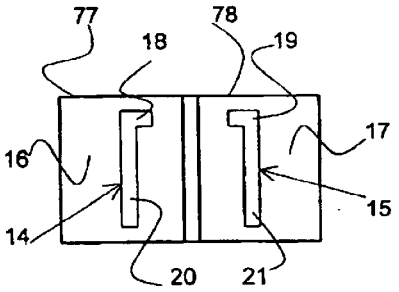
FIGS. 3–6 are different embodiments of the side plate comprising the inventive slitshaped opening for the blowing of the sand into the moulding boxes of the machine performing especially the matchplate technique.

According to the inventive idea, at least one of the end parts of such a slitshaped opening has a greater width than the central part thereof. The side plates 16, 17 of the embodiment disclosed in FIG. 2 are in FIG. 3 disclosed from the top. In FIG. 3 it is easily deduced, that the upper end part 18 of the slitshaped opening 14 in the left sideplate 16 has a rectangular shape and a greater width than the central part 20 of the slitshaped opening 14. The upper end part 19 of the slitshaped opening 15 in the right sideplate 17 has a rectangular shape as well and a greater opening than the central part 21 of the slitshaped opening 15.

When the sand is blown through the openings 14, 15 into the moulding box in question, a higher quantity of sand than by the prior art will be blown in at the outer peripheral region through the end parts 18, 19. Consequently, when the sand subsequently is being squeezed by pressing the cope press plate 22 and the drag plate 23 in direction against each other and the matchplate 11, the hardness of the compacted sand achieved in the outer peripheral region is higher than by the prior art. An improvement in hardness of at least 10% is generally achieved.

Hereby is obtained a greater hardness of the compacted sand of the sand mould in the regions decline of pattern and therefore of cavities in the sand moulds, such as especially the outer regions of the sand moulds. Consequently, the pattern in the moulding box may be arranged closer to the outer side or peripheral region thereof. The outer regions of the sand moulds may even be utilised for smaller cavities for the later moulding of details on the metal product. Important to notice is, that the region of the box available for the pattern moulding the cavity, has become larger in its extension towards the sides. Therefore, a greater capacity for the moulding of the metal products may be achieved by the existing plants.

Figure 4:
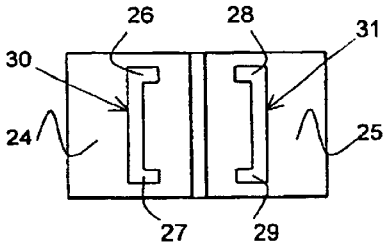
Figure 5:
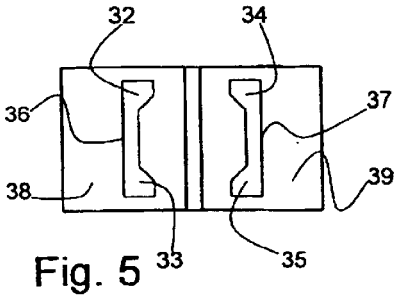
Figure 6:
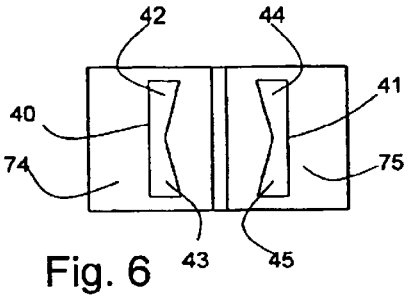

The side plates 16, 17 of the embodiment shown in FIG. 2 may easily be substituted by sideplates such as the ones shown in FIGS. 4–6 having differently shaped end parts of the slitshaped openings for the blow of sand into the boxes 6, 7.

By the embodiment shown in FIG. 4, the sideplates 24, 25 comprise rectangulary shaped end parts 26, 27, 28, 29 at both ends of the slitshaped openings 30, 31. The end parts 26, 27, 28, 29 are enlarged in direction towards each other and thereby towards the clamped matchplate 11 between the boxes 6, 7. The shape of the openings 30, 31 are symmetrical or mirror-like in relation to the matchplate.

Testing were performed with the shape disclosed in FIG. 4 and the following parameters:

Sandcompactability 38–42%

Sand level in container 9 at maximum

Sand pressure at the blow; 3 bar

Pressure force by the squeezing of the sand; 8 kp/cm2

By comparison with testing performed at the same machine having sideplates with the traditional slitshaped openings free of any enlarged width at the ends typical improvement in hardness of the squeezed sand was 5–13% at the peripheral region of the moulds. An general improvement of at least 10% could however be expected. At the central region of the sand moulds at slightly lesser hardness of around 1–3% lesser could be expected, so that a generally more even hardness and strength through over the sand form is achieved. A higher precision of the metal product moulded later on in the sand form is therefore to be expected as well.

Advantageously the length of each of the end parts could typically be between 4% and 50% of the total length of the slitshaped opening.

In FIG. 5 is disclosed a more edged shape of the end parts 32, 33, 34, 35 of the openings 36, 37 in the sideplates 38, 39. Advantageously such shape is adapted to patterns of the matchplate, which are voluminous at the central region where the slitshaped openings 36, 37 are free of any enlargements.

In FIG. 6 is disclosed a further embodiment by which the openings 40, 41 in the plates 74, 75 has enlarged end parts 42, 43, 44, 45 which enlarges gradually from the center and towards the ends of the openings. Such shape may especially be advantageous when the shape of the patterns of the matchplate decreases from the central region and gradually towards the peripheral region.

Figure 7:
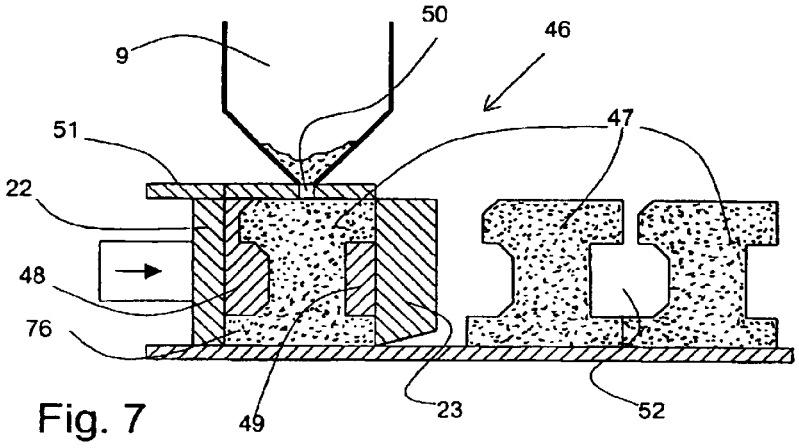
FIG. 7 is a sectional view through a schematically shown squeezing and sand shot section of another machine according to the invention performing the DISAMATIC® technique.

In FIG. 7 is schematically disclosed another embodiment of a sand shot and squeezing section 46, which may substitute the sand shot section 2 of the machine disclosed in FIG. 1 when technique applied for moulding the sand moulds 47 is in accordance with the DISAMATIC® technique.

By the DISAMATIC® technique the patterns 48, 49 are arranged opposite to each other at the first press plate 22 respectively at the second press plate 23. The sand is shot or blown down through a slitshaped opening 50 in the side plate 51 and in between the patterns 48, 49 in the moulding box 76. Thereafter the sand is squeezed by pressing the first press plate 22 and the second press plate 23 in direction towards each other. When two finished sand moulds later on are placed in closed relation the two oppositely moulded patterns together create the total cavity 52 wherein the metal product is to be moulded subsequently.

Figure 8:
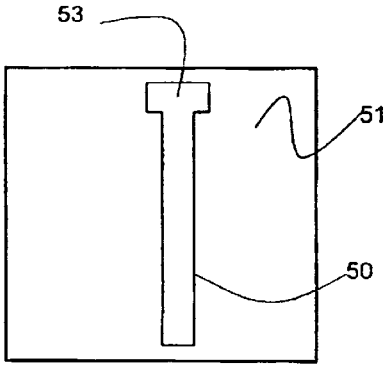
FIGS. 8–11 are different embodiments of the side plate comprising the inventive slitshaped opening for the blowing of the sand into the moulding boxes of the machine performing especially the DISAMATIC® technique.

In its simplest form the inventive slitshaped opening 50 could have a single end part 53 with enlarged width as disclosed in FIG. 8.

Figure 9:
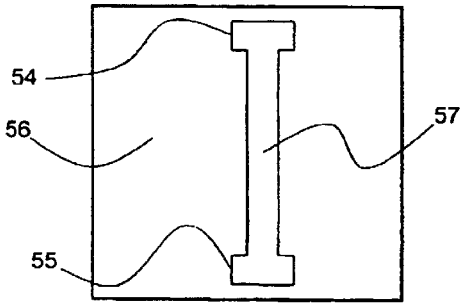

However, especially preferable is the embodiment disclosed in FIG. 9, where both end parts 54, 55 of the opening are enlarged in comparison with the slitshaped central part 57.

A rectangular shape of the end parts 54, 55 are disclosed in FIG. 9. However in FIG. 10 a more edged shape of the end parts 58, 59 of the slitshaped opening 60 arranged in the side plate 61 is disclosed. The shape of FIG. 9 could advantageously be used when the patterns 48, 49 are ended with an abrupt inclination or height difference in relation to the plates 22, 23 so that the greater amount of sand blown in at the end parts are especially concentrated at the periphery.

Figure 10:
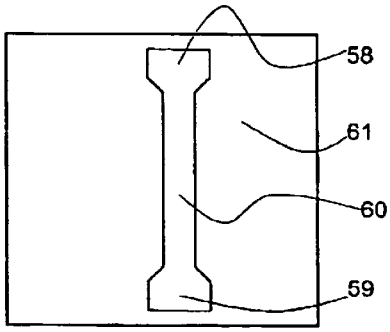

The shape of FIG. 10 is more suitable when the patterns are ended at a lesser inclination. Thereby more sand is blown in at the inclinated part of the pattern than at the central slitshaped part 60 of the opening at FIG. 10

Figure 11:
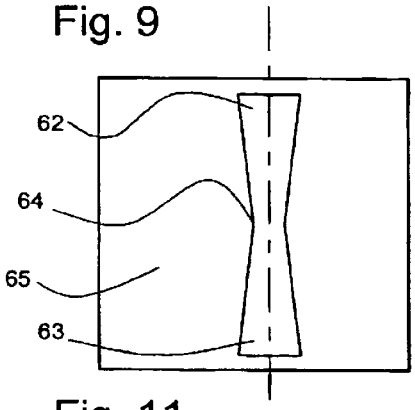

By another embodiment depicted at FIG. 11 the end parts 62, 63 of the opening 64 in the side plate 65 enlarges gradually from the center and towards the ends thereof. When used in connection with patterns having a shape gradually decreasing from the center and towards the peripheral region an especially even hardness of the moulded sand moulds 47 is expected.

Generally in FIGS. 8–11 the enlarged end parts has a greater width to both opposite sides of the opening in comparison with the central part of the opening having a smaller width. The shapes of the disclosed openings in FIGS. 8–11 are so to say "bone"-like in that the enlargements are symmetrical around a longitudinal, central axis 66 disclosed in FIG. 11. Such a generally "symmetrical bone-like" shape of the opening satisfies most different shapes of the used patterns 48, 49 for the DISAMATIC® technique. However, asymmetrically shaped openings is expected to be advantageous when the patterns 48 and 49 are severely different in their geometrical shapes.

However, important to notice is, that the idea of the invention is not limited to any specific geometrical shape of the end parts of the slitshaped opening. satisfactory is alone, that the end part has an enlarged width so that more sand is blown in at the peripheral region and a grater hardness is achieved in that region than by the prior art.

Figure 12:
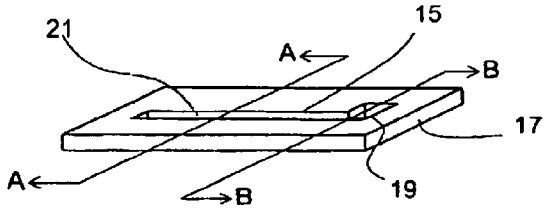
FIGS. 12–14 are different embodiments of the edges of the slitshaped opening.
Figure 13:
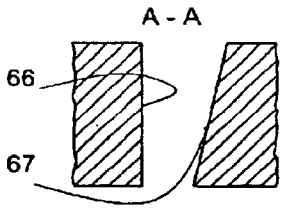
Figure 14:
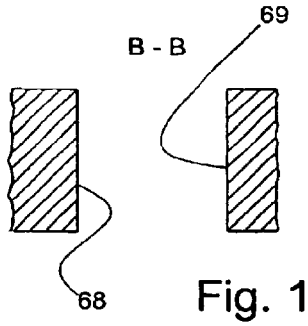

The right side plate 17 of FIG. 3 is disclosed in perspective view in FIG. 12. A vertical section A—A at the central part of the opening in FIG. 12 is disclosed in FIG. 13, and a vertical section B—B at the end part 19 is disclosed in FIG. 14. As shown in FIG. 12 the left edge 66 of the central part 21 of the opening is vertical and the right edge 67 is inclined so that the distance between the edges 66, 67 is reduced downwards. Consequently, the sand is directed slightly away from the pattern 13 when it is blown in through the opening 15 and thereby being concentrated at the voluminous regions where build up of sand is most required for reaching an even hardness through the squeezed sand mould. The erosion of the pattern is thereby reduced considerably. By the disclosed embodiment of FIG. 14 the end part 19 of the opening 15 has vertical, parallel edges 68, 69 as essentially no pattern on the matchplate 11 is available at the peripheral region.

Generally, the opposite edges of any part of the openings may be inclined both or the one thereof for direction the blowing sand towards the region where amount of sand is mostly required.

Figure 15:
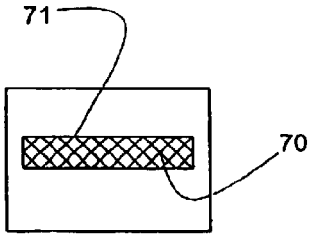
FIGS. 15 and 16 are different features for restraining the return of sand through the slitshaped opening.
Figure 16:
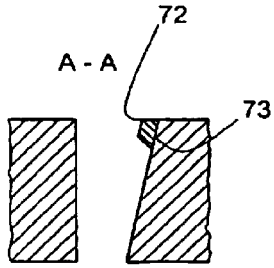

By the embodiments disclosed in FIGS. 15 and 16 two different means of reducing sand return out through the opening are disclosed. Lists 70 are arranged in a grid-like pattern in a slitshaped opening 71 having parallel sides as disclosed in FIG. 15. After the sand is blown in through the opening outlet of sand before the squeezing is minimised by the lists. In FIG. 16 a longitudinally extending bead-like thickening 72 is disclosed at the upper edge 73 in vertical section A—A of the opening 15 in FIG. 12. The bead-like thickening 72 has a severe limiting effect on the tendency of the sand to run out again through the opening.

What is claimed is:

1. Moulding machine (1) for the moulding of sand moulds (4, 5; 47) by blowing sand in through a slitshaped opening (14, 15, 30, 31, 36, 37, 40, 41, 50, 57, 60, 64) extending across a side plate (16, 17, 24, 25, 38, 39, 74, 75, 51, 56, 61,

65) of a moulding box (6, 7, 76), into which box extends a moulding pattern (12, 13, 48, 49), wherein at least one of the end parts (18, 19, 26, 27, 28, 29, 32, 33, 34, 35, 42, 43, 44, 45, 53, 54, 55, 58, 59, 62, 63) of the slitshaped opening has a greater width than the central part (20, 21, 36, 37) thereof.

2. Moulding machine according to claim 1, wherein the at least one end part (18, 19) of the slitshaped opening (14, 15) terminates in a distance from the adjacent side plate (77, 78) of the mould box (6, 7).

3. Moulding machine according to claim 1, wherein the one elongated side of the slifformet opening (14, 15, 30, 31, 36, 37, 40, 41) is essentially straight and the extension of the width is to the opposite elongated side of the opening.

4. Moulding machine according to claim 1, wherein the at least one end part of the opening having an enlarged width (18, 19, 26, 27, 28, 29, 53, 54, 55) has a rectangular shape.

5. Moulding machine according to claim 1, wherein the at least one end part of the opening having an enlarged width (42, 43, 44, 45, 62, 63) has a triangular shape.

6. Moulding machine according to claim 1, wherein the width enlarges gradually from the central part of the slitshaped opening and towards the end (42–45, 62, 63) thereof.

7. Moulding machine according to claim 1, wherein the extension of the at least one end part of the opening having an enlarged width is between 4% and 50% of the total length of the slitshaped opening.

8. Moulding machine according to claim 1, wherein both end parts of the opening has an enlarged width.

9. Moulding machine according to claim 1, comprising two sand moulding boxes (6, 7) clamping a matchplate (11) with moulding patterns (12, 13) extending into the boxes (6, 7) during moulding, wherein slitformed openings (14, 15) are arranged in both sand moulding boxes.

10. Moulding machine according to claim 1, wherein two oppositely arranged patterns (48, 49) are extending into the moulding box (76) during the moulding.

11. Moulding machine according to claim 10, wherein the extension of the width at the end part (53, 54, 55, 58, 59, 62, 63) of the opening (50, 57, 60, 64) is to both opposite sides of the opening in comparison with the central part of the opening having a smaller width.

12. Moulding machine according to claim 10, wherein the shape of the opening at the end part (53, 54, 55, 58, 59, 62, 63) is essentially symmetrical around a longitudinal central axis.

* * * * *